US005634990A

United States Patent [19]

Choi et al.

[11] Patent Number: 5,634,990

[45] Date of Patent: Jun. 3, 1997

[54] FE-MN VIBRATION DAMPING ALLOY STEEL AND A METHOD FOR MAKING THE SAME

[75] Inventors: Chong-Sool Choi, Seoul; Man-Eob Lee, Kyungki-do; Seung-Han Baek, Kyungki-do; Yong-Chul Son, Kyungki-do; Jeong-Cheol Kim, Seoul; Joong-Hwan Jun, Seoul; Young-Sam Ko, Seoul, all of Rep. of Korea

[73] Assignee: Woojin Osk Corporation, Rep. of Korea

[21] Appl. No.: 519,546

[22] Filed: Aug. 25, 1995

Related U.S. Application Data

[63] Continuation-in-part of Ser. No. 276,995, Jul. 19, 1994, abandoned.

[30] Foreign Application Priority Data

Oct. 22, 1993 [KR] Rep. of Korea ..... 93-21973

[51] Int. Cl.[6] ..... C21D 8/00

[52] U.S. Cl. ..... 148/547; 148/619; 148/620; 148/329

[58] Field of Search ..... 148/547, 619, 148/620, 329; 420/72, 1

[56] References Cited

U.S. PATENT DOCUMENTS 4,875,933 10/1989 Wan ..... 420/129
5,290,372 3/1994 Choi et al. ..... 148/540

FOREIGN PATENT DOCUMENTS 55-91956 7/1980 Japan .

OTHER PUBLICATIONS

Hansen, M. Constitution of Binary Alloys, McGraw–Hill Book Company, Inc. 1958, pp. 664–668.

*Primary Examiner*—Sikyin Ip
*Attorney, Agent, or Firm*—Cooper & Dunham LLP

[57] ABSTRACT

An Fe-Mn vibration damping alloy steel having a mixture structure of $\epsilon$, $\alpha'$ and $\gamma$. The alloy steel consists of iron, manganese from 10 to 24% by weight and limited amounts of impurities. The alloy steel is manufactured by preparing an ingot at a temperature of 1000° C. to 1300° C. for 12 to 40 hours to homogenize the ingot and hot-rolling the homogenized ingot to produce a rolled alloy bar or plate, performing solid solution treatment on the alloy steel at 900° C. to 1100° C. for 30 to 60 minutes, cooling the alloy steel by air or water, and cold rolling the alloy steel at a reduction rate of greater than 0% and below 30% at around room temperature.

1 Claim, 5 Drawing Sheets

(Fe-17%Mn)

Comparative alloy
(No cold rolling)
SDC = 5%
Amplitude

Comparative alloy
(Cold rolling)
SDC = 5%
Amplitude

Present invention
(No cold rolling)
SDC = 25%
Amplitude

Present invention
(Cold rolling)
SDC = 30%
Amplitude
Time (Before cold rolling)

(Reduction of 10%, thin ε plates)

(Reduction of 35%, thick ε plates)

FE-MN VIBRATION DAMPING ALLOY STEEL AND A METHOD FOR MAKING THE SAME

This application is a continuation-in-part application of U.S. Ser. No. 08/276,995 filed Jul. 19, 1994, now abandoned.

BACKGROUND OF THE INVENTION (1) Field of the Invention

The present invention relates to an Fe-Mn vibration damping alloy steel that has an excellent vibration damping capacity, and a method for making the Fe-Mn vibration damping alloy steel at a low production cost.

(2) Description of the Prior Art

In line with a trend for high-grade and high precision aircraft, ships, automotive vehicles and various machinery, vibration damping alloy is widely used in the many kinds of machine parts that are sources of vibration and noise. Study of vibration damping alloys has been lively because of the increase in demand for such alloys.

Vibration damping alloys developed and used so far are classified into following types: Fe-C-Si and Al-Zn which are of the composite type; Fe-Cr, Fe-Cr-Al and Co-Ni which are of the ferromagnetic type; Mg-Zr, Mg and $Mg_2Ni$ which are of the dislocation type; and Mn-Cu, Cu-Al-Ni and Ni-Ti which are of the twin type. The above vibration damping alloys have excellent vibration damping capacities but have poor mechanical properties. Thus, the alloys cannot be used widely; and since they contain a lot of expensive elements, the production costs are high, limiting the industrial use of the alloys.

A solution of the above problem is disclosed in U.S. Pat. No. 5,290,372 (jong-Sul Choi, et al.). This patented alloy is an Fe-Mn (10 to 22%) vibration damping alloy steel having a partial martensitic structure. As a method for making the alloy, an Fe-Mn (10–22%) ingot is homogenized at 1000° C. to 1300° C. for 20 to 40 hours and hot-rolled. After solid solution treatment of the ingot at 900° to 1100° C. for 30 minutes to an hour, air cooling or water quenching is carried out to produce a partial epsilon martensite from the parent phase, austenite. This damping mechanism is entirely different from those of the conventional damping alloys, and has a characteristic of absorbing vibrational energy by movement of the $\epsilon/\gamma$ interface under external vibration stress. However, we have made an effort to further improve excellent vibration damping alloy steels and we succeeded in inventing a vibration damping alloy steel of the present invention.

SUMMARY OF THE INVENTION

According to the alloy of the present invention, the composition range of Mn is a little broader than that of U.S. Pat. No. 5,290,372 and a cold rolling process for the manufacture of the alloy is added.

The present invention provides an Fe-Mn vibration damping alloy steel having a mixture structure of $\epsilon$, $\alpha'$and $\gamma$, the alloy steel consisting of iron, manganese at 10 to 24% by weight, and impurities such as: carbon of up to 0.2% by weight, silicon of up to 0.4% by weight, sulfur of up to 0.05% by weight, and phosphorus of up to 0.05% by weight.

In accordance with the present invention, a method for making an Fe-Mn vibration damping alloy steel comprises the steps of:

melting an alloy consisting of iron, 10 to 24% by weight of manganese, and impurities such as carbon of up to 0.2% by weight, silicon of up to 0.4% by weight, sulfur of up to 0.05% by weight and phosphorus of up to 0.05% by weight;

casting the melted alloy into a mold to produce a metal ingot;

heating the ingot at a temperature of 1000° C. to 1300° C. for 12 to 40 hours to homogenize the ingot, and hot-rolling the homogenized ingot to produce a rolled alloy steel;

performing a solid solution treatment on the alloy steel at 900° to 1100° C. for 30 to 60 minutes;

cooling the alloy steel by air or water at room temperature; and cold rolling the alloy steel at a reduction rate of below 30% around room temperature (25° C.±50° C.).

BRIEF DESCRIPTION OF THE DRAWINGS

FIG. 4A shows a free vibration damping curve before cold rolling an Fe-4% Mn alloy (as water-quenched), FIG. 4B shows a free vibration damping curve after cold rolling the Fe-4% Mn alloy, FIG. 4C shows a free vibration damping curve before cold rolling Fe-17% Mn alloy (as water-quenched), and FIG. 4D shows a free vibration damping curve after cold rolling the Fe-17% Mn alloy;

DETAILED DESCRIPTION OF THE PRESENT INVENTION

Figure 1:
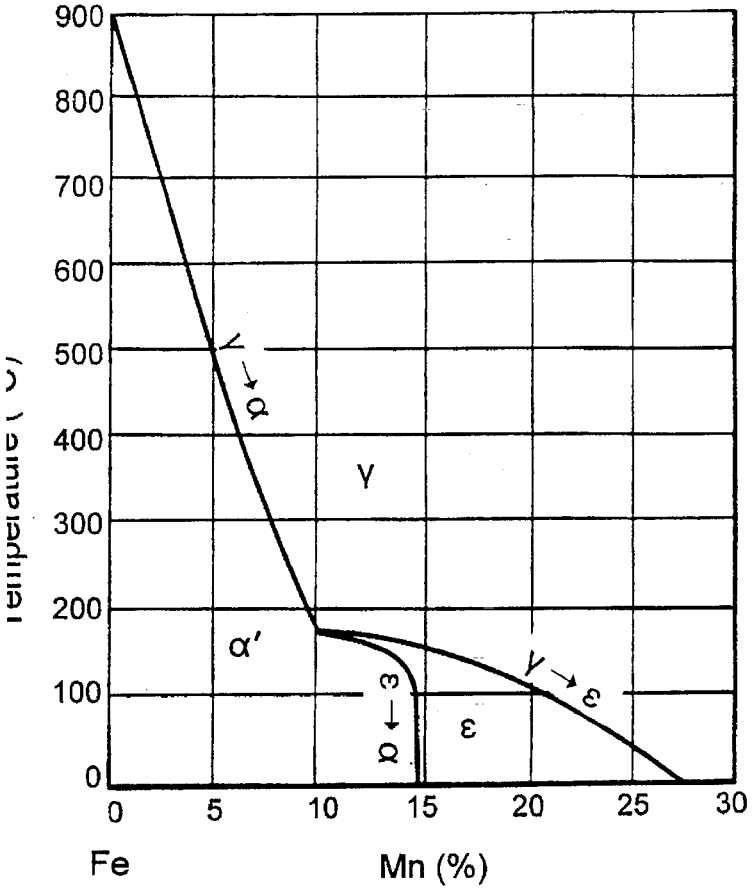
FIG. 1 is a binary phase diagram of an Fe-Mn alloy.

In making the alloy steels according to the present invention, an amount of electrolytic iron and an electrolytic manganese is weighed to contain 10 to 24% manganese by weight and the remainder iron. The iron is melted first by heating in a melting furnace at more than 1500° C.; and then the manganese is charged and melted.

After that, the melted mixture is cast into a mold to produce an ingot. Subsequently, the cast ingot is homogenized at 1000° C. to 1300° C. for 12 to 40 hours and then the homogenized ingot is hot-rolled to produce a rolled metal of a predetermined dimension.

The rolled metal is subjected to a solid solution treatment at 900° C. to 1100° C. for 30 to 60 minutes and cooled by air or water. Finally the rolled metal is again cold rolled around room temperature (25° C.±50° C.) so as to have a reduction rate of less than 30%, thereby obtaining Fe-Mn alloy steels having high vibration damping capacities.

The reason why the above condition is determined in the present invention is as follows. The homogenizing condition is defined to be at 1000° C. to 1300° C. for 12 to 40 hours so that the manganese, the main element, may be segregated during the period of time the ingot is cast. Thus, when the ingot is heated at a high temperature of 1000° C. to 1300° C., the high concentrated manganese is diffused into a low concentration region which homogenizes the composition of the manganese.

If homogenization of the ingot is performed at temperatures below 1000° C., the diffusion rate becomes slower. Therefore it takes more then 40 hours to homogenize, and the production cost is increased. If the temperature for the homogenization is more than 1300° C., the homogenization time may be reduced to be within 12 hours, but a local melting phenomenon may occur at the grain boundary where the manganese is segregated during casting. Accordingly, the homogenization is preferably performed at 1000° C. to 1300° C. for 12 to 40 hours.

The solid solution treatment is performed at 900° C. to 1100° C. for 30 to 60 minutes. If the treatment is carried out at higher than 1100° C., the grains of the alloys are coarsened which deteriorates the tensile strength. If the temperature is too low, such as less than 900° C., the grains become so small that raising the tensile strength decreases the martensite start temperature(Ms). Thus, a small amount of epsilon martensite is produced and the damping capacity is lowered. Accordingly, the optimum condition to have both excellent tensile strength and damping capacity is at 900° C. to 1100° C. for 30 to 60 minutes.

The alloy of the present invention preferably contains manganese of 10 to 24% by weight, see, FIG. 1 of the binary phase diagram. Alloys which contain up to 10% manganese create α' martensite; alloys which contain from 10 to 15% manganese create a 3-phase mixture structure of ε+α'+γ; and alloys which contain from is to 28% manganese create a 2-phase mixture structure of ε+γ.

The Fe-Mn vibration damping mechanism, as mentioned above, absorbs vibration energy by movement of the ε/γ interface under external vibration stress. Accordingly, if the manganese alloy is less than 10% Mn only one phase, α' martensite is created and the vibration damping effect hardly occurs. However, as illustrated in FIG. B, because ε and γ martensites are extensive in the 10 to 28% Mn alloys, a lot of ε/γ interfaces exist which yields high vibration damping effects. Moreover, if cold rolling is carried out in the alloy of these compositions at around room temperature (25° C.±50° C.), more ε martensite is induced by the external stress which increases the total interfacial area of the ε/γ interface. Thus, the damping capacity is remarkably more enhanced than before cold rolling.

If however, the amount of Mn is more than 24%, the Neel temperature of austenite, Tn (i.e., a magnetic transition temperature at which paramagnetic is changed to antiferromagnetic), is higher than the room temperature, and the austenite is stabilized. Therefore, greater amounts of cold rolling at around room temperature can produce the ε martensite, and simultaneously, the slip system of the austenite operates to generate a great density of dislocations. Since these dislocations act as an obstacle against the movement of the ε/γ interface during vibrations, the damping capacity cannot be improved by cold rolling when the alloy has more than 24% Mn by weight. Accordingly, the composition of Mn is defined to the range of 10 to 24% because ε martensite is produced preferentially by cold rolling at around room temperature without slip dislocation.

Figure 6:
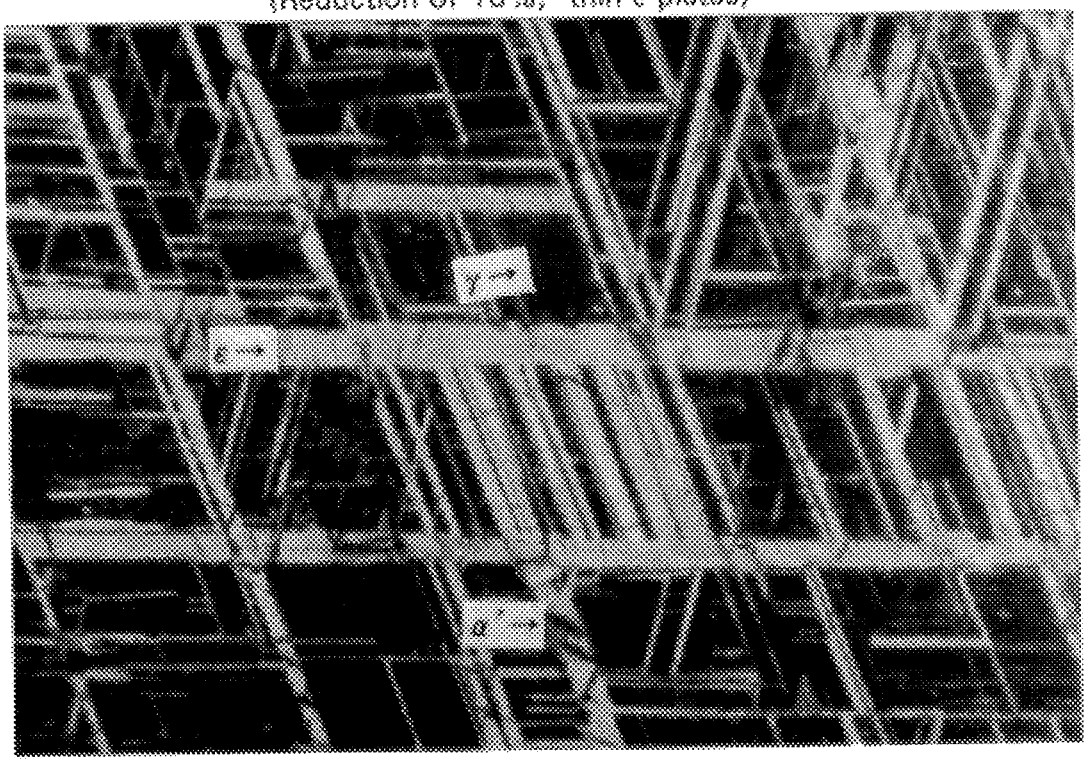
FIG. 6 is an optical micrograph showing $\epsilon+\alpha'+\gamma$ (three-phase) structure formed by cold rolling an Fe-17% Mn alloy with a reduction rate of 10%.
Figure 7:
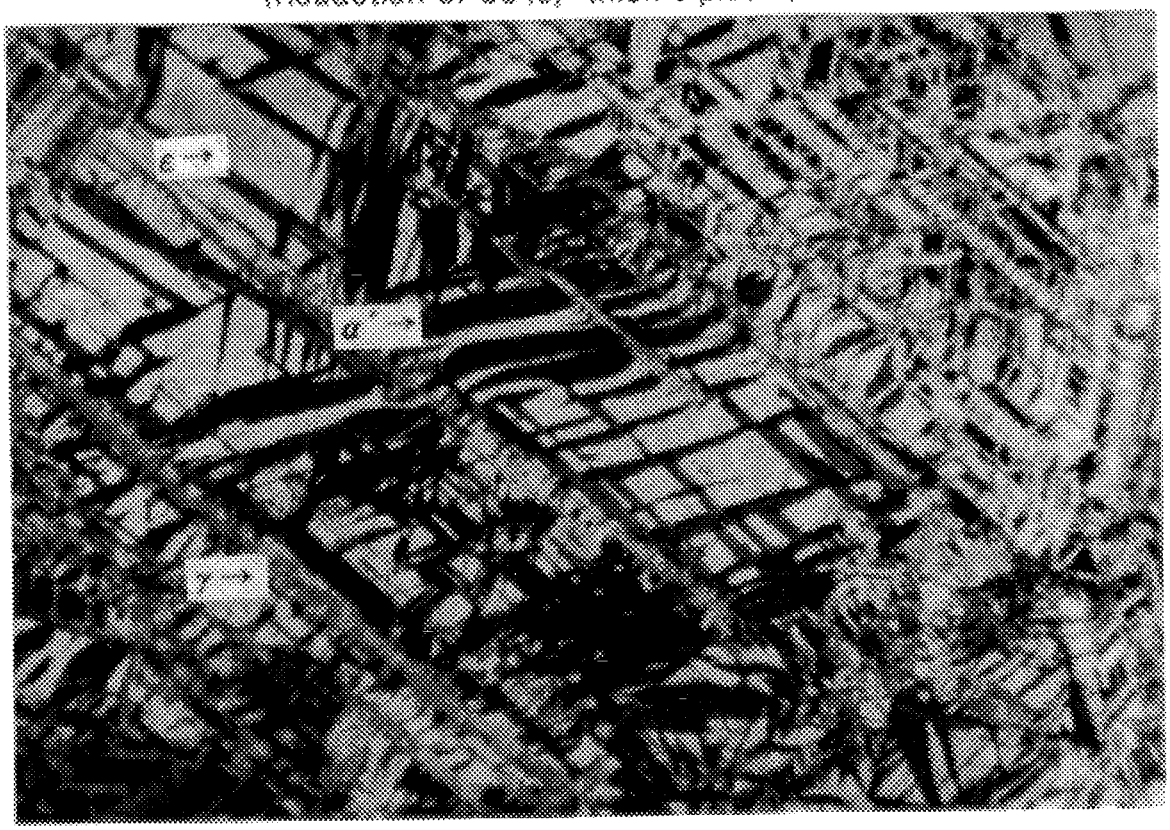
FIG. 7 is an optical micrograph showing $\epsilon+\alpha'+\gamma$ (three-phase) structure formed by cold rolling an Fe-17%Mn alloy with a reduction rate of 35%.

As illustrated in FIG. 6, if the cold rolling is performed at a reduction of less than 30% at around the room temperature, more fine and thin ε plates are produced within the γ austenite by the cold rolling which increases the total interface area of the ε/γ interface, and higher vibration damping capacity is obtained than before the cold rolling. However, as illustrated in FIG. 7, if the amount of cold rolling is increased to more than 30%, coalescence of ε martensite plates occurs, and the ε/γ interface area is reduced. Also, the α' martensite produced within the ε martensite restrains the movement of the ε/γ interface, and a lot of dislocations are produced inside the ε and γ martensites. These dislocations interact with the ε/γ interface disturbing the movement of the ε/γ interface, thereby degrading the vibration damping capacity. In other words, if the cold rolling is performed at a reduction of less that 30%, more fine and thin ε plates are produced within the γ austenite, thereby increasing the total interface area of the ε/γ interface and thus increasing the vibration damping capacity.

Although with cold rolling at a reduction rate of greater than 0% and less than 30%, some fine and small α' martensites are also produced in the ε martensite, the improvement of the vibration damping capacity due to the increase in the ε/γ interface area is much larger than deterioration of the vibration damping capacity due to the production of α' martensites.

However, if the cold rolling is performed at a reduction rate of more than 30%, coalescence of e martensite plates occurs, thereby reducing the total ε/γ interface area because of enlargment of the width of ε martensite plates. In addition, at reduction rates of more than 30%, more α' martensites are formed within the ε martensite. Both of these effects substantially degrade the vibration damping capacity. FIG. 7 illustrates the thick ε plates caused by the coalescence of ε martensite plates, and the presence of fine and more numerous α' martensites.

The alloy of the present invention contains carbon of up to 0.2% by weight, silicon of up to 0.4% by weight, sulfur of up to 0.05% by weight, and phosphorus of up to 0.05% by weight as impurities.

If the amount of impurities is higher, the impurity elements are diffused to the ε/γ interfaces which locks the interface, and movement of the ε/γ interfaces is difficult, thereby degrading the vibration damping capacities.

Table 1 shows the comparison of results of the vibration damping capacities in the alloy of the present invention and the conventional alloy according to the cold rolling process.

The alloy of the present invention that has undergone cold rolling has a superior vibration damping effect compared to the alloy that is not cold rolled.

TABLE 1

| Name of Alloy | Specific Damping Capacity (SDC) Air-Cooled | Water-Quenched | 10% Cold-Rolled | 20% Cold-Rolled | 35% Cold-Rolled | Note |
|---|---|---|---|---|---|---|
| Fe - 8% | 6 | 6 | 6 | 6 | 5 | Comparative Alloy steel |
| Fe - 10% Mn | 10 | 10 | 14 | 14 | 9 | Alloy steel of the present invention |
| Fe - 13% Mn | 12 | 12 | 16 | 16 | 11 | |
| Fe - 15% Mn | 15 | 15 | 20 | 20 | 14 | |
| Fe - 17% Mn | 25 | 25 | 30 | 30 | 23 | |
| Fe - 20% Mn | 25 | 25 | 30 | 30 | 23 | |
| Fe - 23% Mn | 22 | 22 | 27 | 27 | 21 | |
| Fe - 24% Mn | 15 | 15 | 20 | 20 | 14 | |
| Fe - 26% Mn | 9 | 9 | 10 | 10 | 9 | Comparative Alloy steel |
| Fe - 4% Mn | 5 | 5 | 5 | 5 | 5 | Comparative Alloy steel |
| Carbon Steel | 5 | 5 | 5 | 5 | 5 | Conventional Steel |

FIG. 1 shows the Fe-rich side of Fe-Mn binary phase diagram which is the basis of this invention. Transformation temperatures of each phase are determined using a dilatometer by cooling at a rate of 3° C./min. In FIG. 1, α' martensite is formed in the case of up to 10% Mn by weight. There is a mixture structure of ε+α'+γ in the case of 10 to 15% Mn by weight. There is a dual phase structure of ε+γ in the case of 15 to 28% Mn by weight and a single phase structure of γ in the case of more than 28% Mn by weight.

Figure 2:
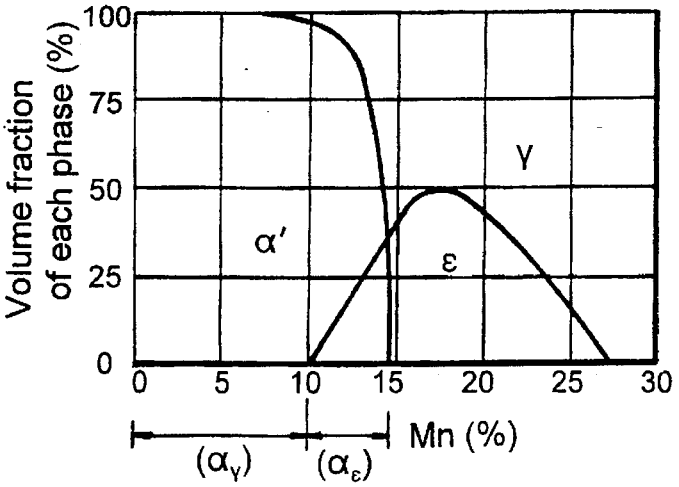
FIG. 2 shows a transformation amount of the Fe-Mn alloy at room temperature.

FIG. 2 shows a volume fraction of each phase by an X-ray diffraction analysis method after each alloy is subjected to solid solution treatment at 1000° C. and air-cooled to the room temperature.

As shown in Tables 1 and 2 and FIGS. 1 and 2, the Mn percentages by weight corresponding to α' martensitic alloy have a poor vibration damping capacity and the alloy of ε+α'+γ mixture structure has excellent vibration damping capacity as well as tensile strength.

Table 2 shows a comparison of vibration damping capacities according to martensitic structure in case of 10% reduction by cold rolling.

TABLE 2

| Name of Alloy | Structure | Specific Damping Capacity (SDC) | Tensile Strength (Kg/mm2) |
|---|---|---|---|
| Fe - 4% Mn | α' martensite | 5 | 66 |
| Fe - 17% Mn | ε + α' + γ martensite | 30 | 70 |
| Low Carbon Steel | Tempered martensite | 5 | 49 |

The alloy having the ε+α'+γ mixture structure has a greater vibration damping capacity than that of α' martensitic alloy, because the sub-structure of the α' martensite consists of dislocations and absorbs vibration energy by movement of the dislocations. In the alloy of the ε+α'+γ mixture structure, if the alloy receives vibrational stress, the ε/γ interface moves and absorbs vibration energy yielding an excellent vibration damping capacity.

Figure 3:
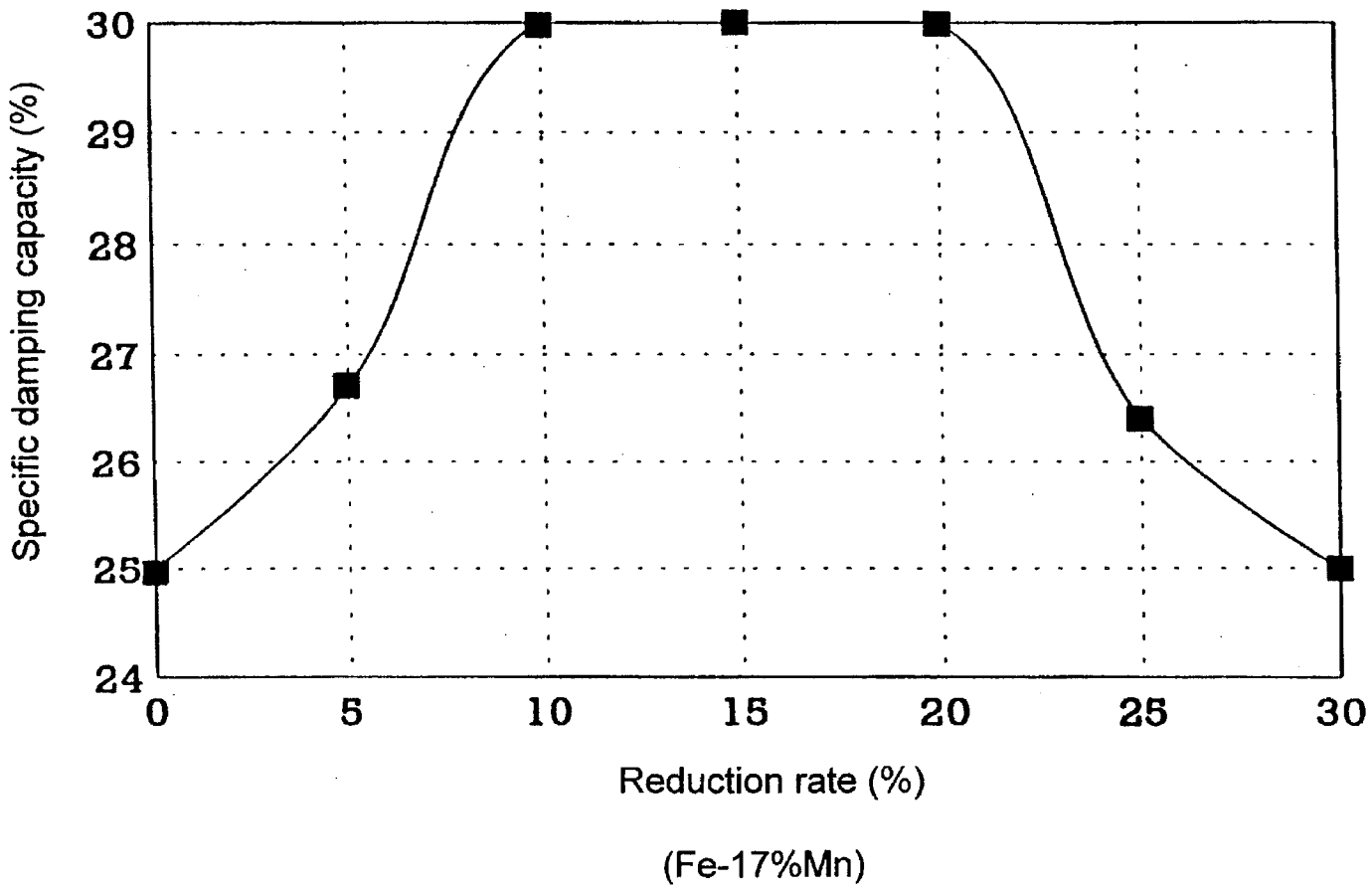
FIG. 3 shows specific damping capacities according to the amount of cold rolling of the Fe-17%Mn alloy.

FIG. 3 shows the variation of a specific damping capacities according to the amount of cold rolling in case of the Fe-17% Mn alloy. The specific damping capacity (SDC) is increased in accordance with the increase in the amount of cold rolling, and maximum vibration damping capacity is presented at the reduction rate from 10 to 20%. If the amount of cold rolling is more than about 20%, the SDC is decreased. If the amount of cold rolling is more than about 30%, the vibration damping capacity is less than the vibration damping capacity without cold rolling.

Figures 4A, 4B, 4C, 4D:
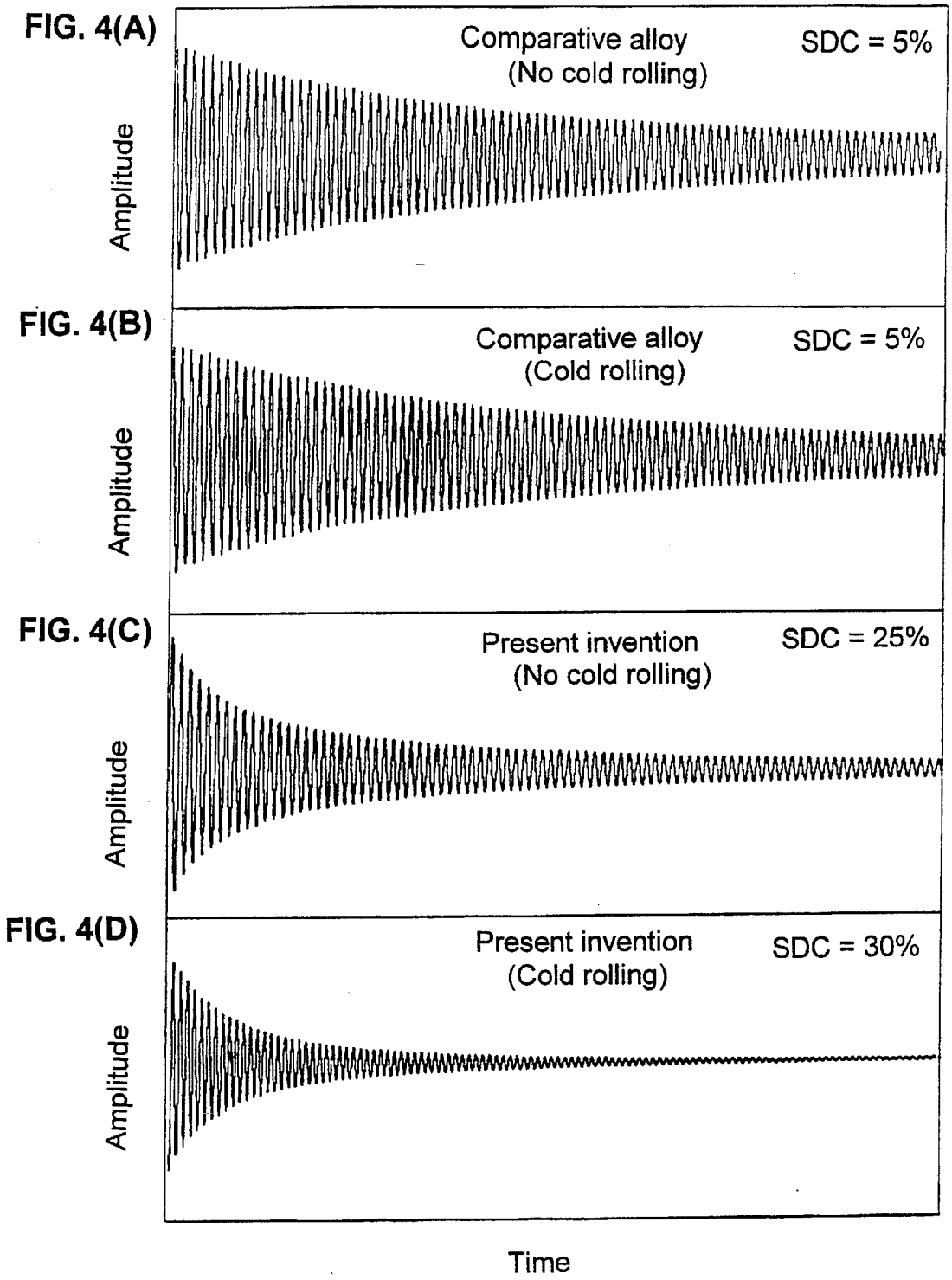
FIGS. 4A to 4D show free vibration damping curves before and after cold rolling of a comparative alloy and an alloy of the present invention, specifically.
Figure 5:
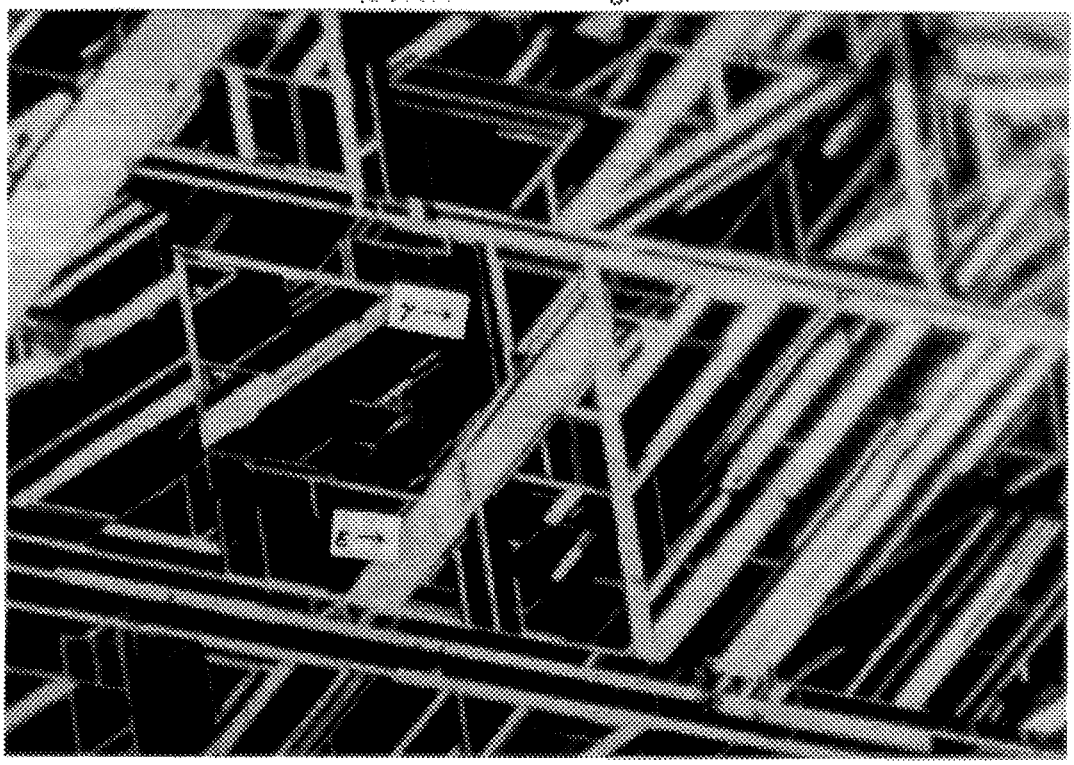
FIG. 5 is an optical micrograph showing $\epsilon+\gamma$ (two-phase) structure before cold rolling an Fe-17% Mn alloy.

FIGS. 4A to 4D show free vibration damping curves of a comparative alloy and the alloy of this invention before and after the cold rolling. These curves were measured by means of a torsional pendulum type measuring apparatus at the maximum surface shear strain of $\gamma=8\times10^{-4}$, using a round shape specimen. The comparative alloy (Fe-4% Mn) has a small vibration damping capacity after water quenching (FIG. 4A), and the vibration damping effect is not improved even with 15% reduction by cold rolling (FIG. 4B). However, as an example of one alloy of this invention, Fe-17% Mn alloy has a remarkable vibrational amplitude decay after water quenching for high temperature rolling (FIG. 4C). However, if 15% reduction by cold rolling is further carried out at the room temperature, the vibrational amplitude decay is more remarkable as shown in FIG. 4D.

The alloys of this invention, as mentioned above, have vibration damping capacities and mechanical properties which are superior to conventional alloys.

While this invention has been described in connection with what is presently considered to be the most practical and preferred embodiments, it is to be understood that the invention is not limited to the disclosed embodiments, but, on the contrary, it is intended to cover various modifications and equivalent arrangements included within the spirit and scope of the appended claims.

What is claimed is:

1. A method for making an Fe-Mn vibration damping alloy steel, comprising the steps of:

melting an alloy consisting of, 10 to 24% manganese by weight, iron and incidental impurities to produce a melted alloy; the iron and incidental impurities together constitute the remaining percentage by weight;

subsequently, casting the melted alloy into a mold to produce a metal ingot;

subsequently, heating the ingot at a temperature of 1000° C. to 1300° C. for 12 to 40 hours to homogenize the ingot, and hot-rolling the homogenized ingot to produce a rolled alloy steel;

subsequently, performing a solid solution treatment on the alloy steel at 900° to 1100° C. for 30 to 60 minutes;

subsequently, cooling the alloy steel by air or water to room temperature; and subsequently, cold rolling the alloy steel at a reduction rate of greater than 0% and less than 30% around room temperature to increase the vibration damping capacity.

* * * * *